US005807182A

United States Patent [19]

Frost

[11] Patent Number: 5,807,182

[45] Date of Patent: Sep. 15, 1998

[54] BILLIARDS-TYPE PLAYING TABLE

[76] Inventor: Barry John Frost, Lote "N", Praia Da Quinios, P-3080 Figuira Da Foz, Portugal

[21] Appl. No.: 571,901

[22] PCT Filed: Jul. 1, 1994

[86] PCT No.: PCT/GB94/01432

§ 371 Date: Jun. 17, 1996

§ 102(e) Date: Jun. 17, 1996

[87] PCT Pub. No.: WO95/01211

PCT Pub. Date: Jan. 12, 1995

[30] Foreign Application Priority Data

Feb. 7, 1993 [GB] United Kingdom ..... 9313744

[51] Int. Cl.[6] ..... A63D 15/00

[52] U.S. Cl. ..... 473/29; 273/DIG. 8

[58] Field of Search ..... 473/4, 29, 117; 273/DIG. 8

[56] References Cited

U.S. PATENT DOCUMENTS 3,319,958 5/1967 Bender .
3,337,216 8/1967 Miller et al. .
3,455,551 7/1969 Untiedt ..... 473/29 X
3,495,825 2/1970 Nielsen .
3,670,049 6/1972 Stein et al. ..... 473/117 X

FOREIGN PATENT DOCUMENTS 2751965 5/1978 Germany .
1032719 6/1966 United Kingdom .

*Primary Examiner*—William H. Grieb
*Attorney, Agent, or Firm*—Foley & Lardner

[57] ABSTRACT

A billiards table comprises a playing bed (12) of sandwich construction having a playing surface which mimics the bounce of slate for a billiards ball, an edge member (16) for the surface formed of moulded plastics and having a cushioned surface, and legs (15) fixed to the underside of the table. The edge member (16) incorporates channel formations (21) to receive the balls, which communicate with the pockets through the edge. The playing surface may be cloth covered (as is conventional) or may have a simulated cloth surface moulded on a plastic top layer.

15 Claims, 6 Drawing Sheets

BILLIARDS-TYPE PLAYING TABLE

This invention relates to a table for playing billiards of a type also used for snooker and pool.

All such tables will hereinafter be referred to as billiards tables.

Good quality billiards tables, and certainly those provided for championships, always use a so-called slate bed, i.e. a large slab of slate covered with a woven green cloth. The table edge and supports are in heavy wood, with 'pockets' around the edge to receive the balls during play. Such tables are enormously heavy e.g. 500 kgs and are not normally moved. Other billiards tables are known in which the playing surface or bed is of some other lighter material, such as wood. However, these tables cannot be used for serious play and in no way reproduce the solidity or other characteristics of a table with a slate bed.

The invention aims to provide a billiards table which is light enough to be moved, but which also provides a playing bed which replicates the playing characteristics of a slate bed.

The invention provides a billiards table comprising a playing bed of sandwich construction having a playing surface which mimics the bounce of slate for a billiards ball, an edge member for said surface formed of moulded plastics and having a cushioned surface, and legs fixed to the underside of the table. Preferably, the legs at one end of the table are adapted to receive wheels so that the table can be moved by lifting the other end only. Further, the invention proposes a billiards table comprising a playing bed supported on legs with a cushioned edge surrounding the bed, wherein said edge is formed of moulded plastics and incorporates external channel formations, to receive the balls, which communicate with the pockets through said edge.

Much depends upon the construction of the playing bed, and the invention proposes a panel member suitable for use as the playing bed of a billiards table which is of sandwich construction with a solid inflexible base layer, and intermediate relatively resilient layer, and a playing surface layer which is relatively hard but flexible. The cloth fabric feel may be provided either by an actual cloth, or by a moulded surface finish which retains that feel.

Finally, the invention also encompasses a self-supporting panel member comprising a plastics member one surface of which is moulded with a finish having the feel of a cloth fabric. Such a panel member may have utility in fields other than the construction of a billiards table.

In order that the invention shall be clearly understood, an exemplary embodiment thereof will now be described with reference to the accompanying drawings, in which.

Figure 1:
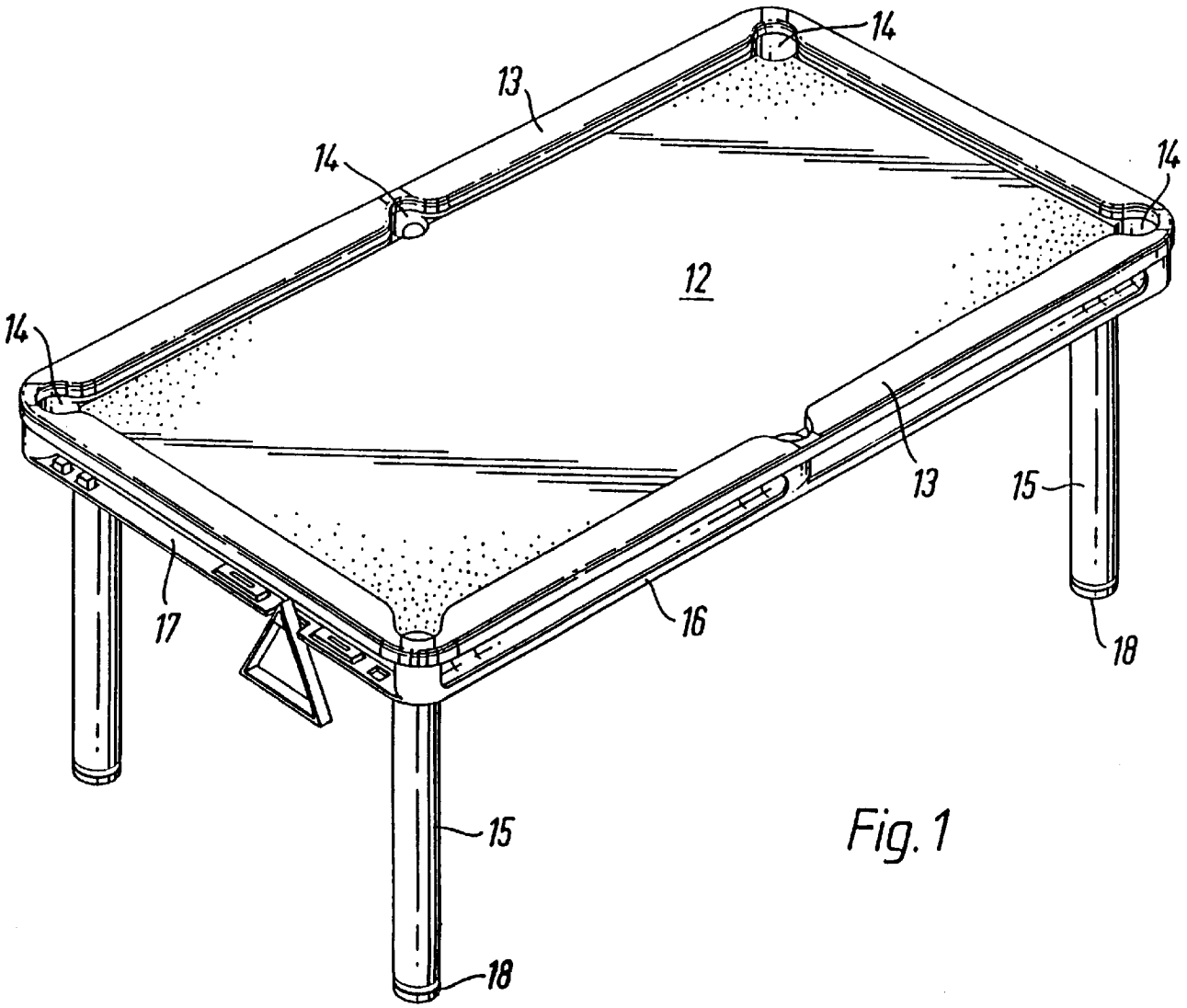
FIG. 1 shows a perspective view of a billiards table in accordance with the invention.

In FIG. 1, a billiards table has a playing bed 12, cushions 13 with pockets 14 and legs 15. As is well known, the cushions are the padded edges of the playing surface from which the balls can rebound; the pockets are to receive balls which enter them during play. The formation of edge members 16 which include the pockets 14 and which are covered to form cushions 13 is described later. The edge member 17 at one end of the table has built in holders for cues, cue chalk, a spirit level and a triangle for the game of snooker. There are four holes through the edge member 17 (not shown in Figures). Each of the legs 15 has a rotatable foot 18 for levelling the table. The legs of the table may additionally or alternatively be provided with castors.

Figure 2:
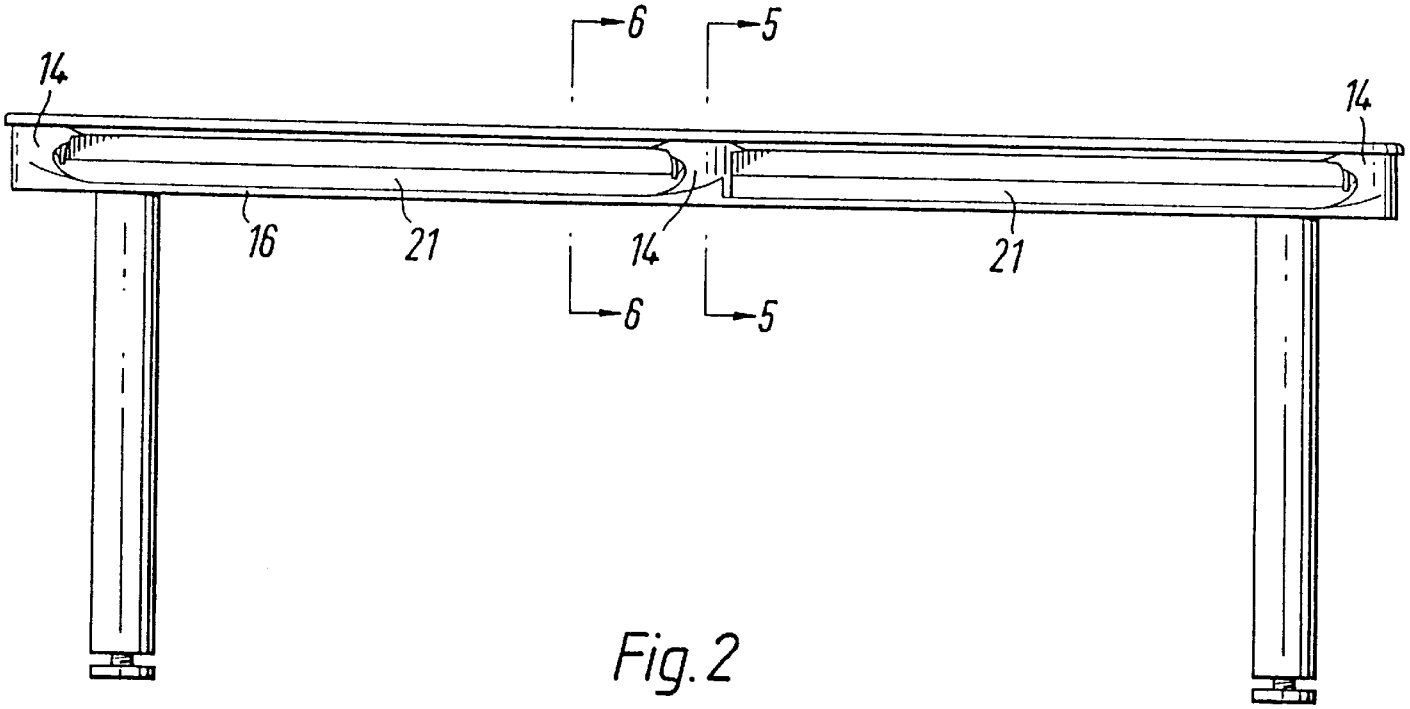
FIG. 2 shows a side elevation of the table in FIG. 1.

Conventionally the pockets of billiards tables each have a small string bag into which the balls fall when they enter the pockets. In the present case, the edge members 16 which run along each long side of the table are themselves moulded so as to provide retaining channels 21. This is clearly illustrated in FIGS. 2,4 and 6. Each channel 21 in FIG. 2 is long enough to retain all or the majority of the balls in play on the table. For ease of manufacture, the individual pockets may be pre-moulded as separate cup shapes, and then incorporated in the mould before an edge member is mounded around them.

Figure 3:
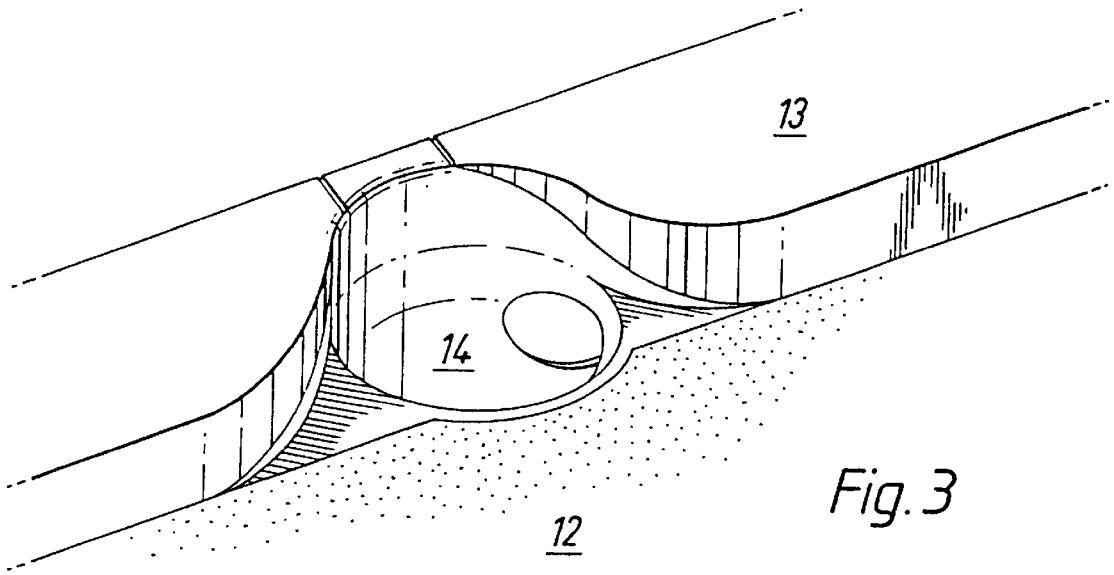
FIG. 3 shows a view of one of the middle pockets, seen from over the playing bed.
Figure 4:
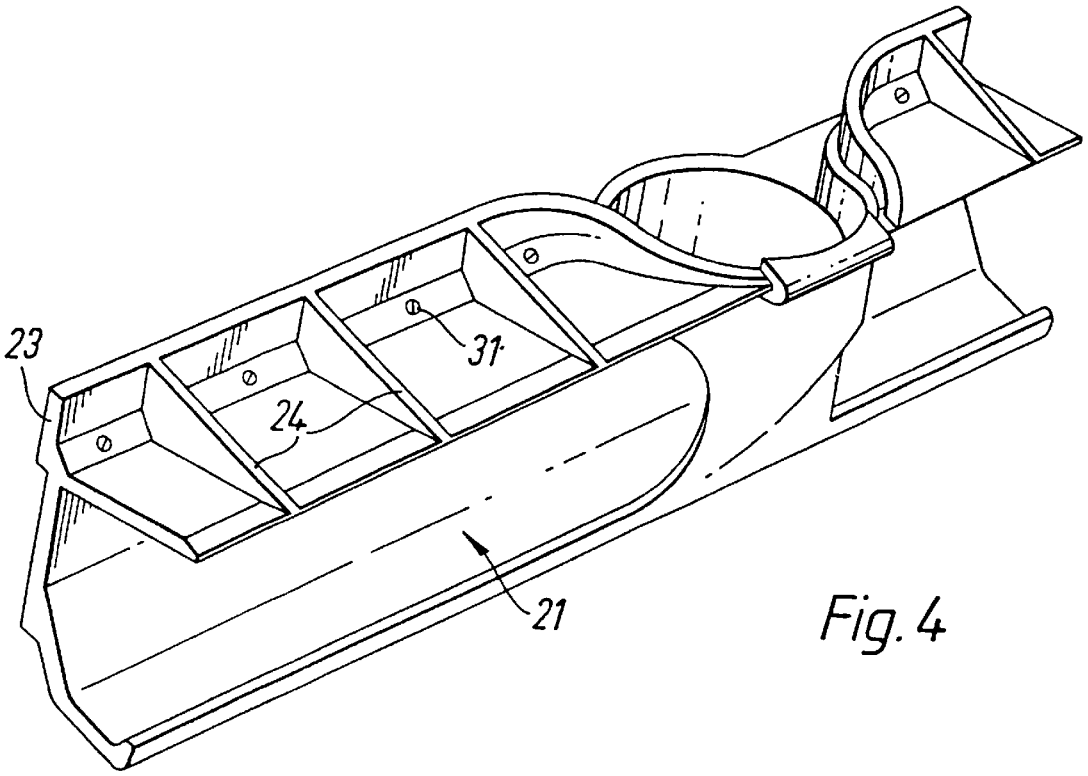
FIG. 4 shows a perspective view of a portion of the moulded edge, including the pocket seen from the outside.
Figure 5:
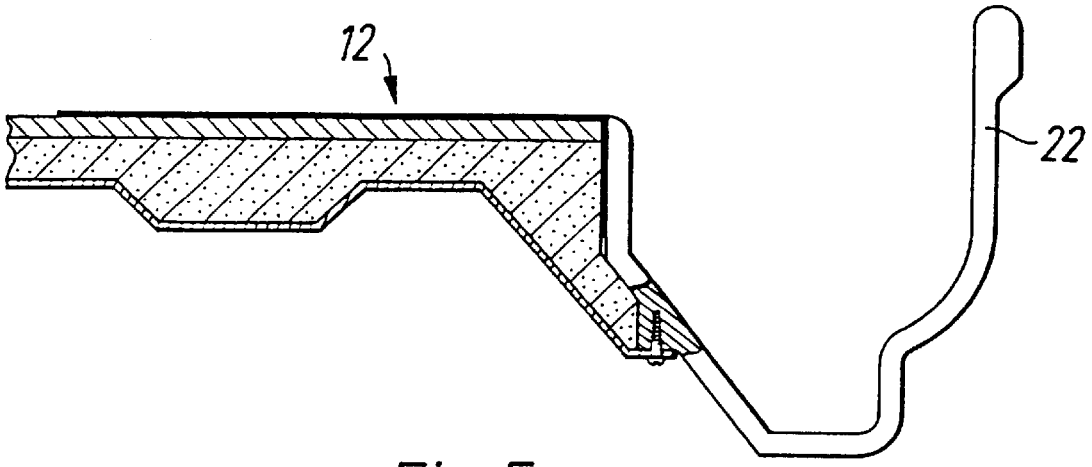
FIGS. 5 & 6 show sectional views on the arrows 5—5 and 6—6 in FIG. 2.

It can also be seen from FIG. 2 that the left hand channel 21 communicates with both the centre and left hand pockets 14, while the right hand channel 21 communicates only with the corner pocket at the right hand end. The section in FIG. 5 shows how the back of the pocket 22 is high enough above the playing surface 12 to stop any ball which enters the pocket. The rest of the pocket is shaped as shown in FIGS. 3 and 4 to ensure that a ball entering the pocket is guided by its shape into one of the channels 21. The corner pockets 14 are shaped in analogous form. A rubber or foam lining may cover the inner surfaces of the pockets, as appropriate.

Figure 11A:
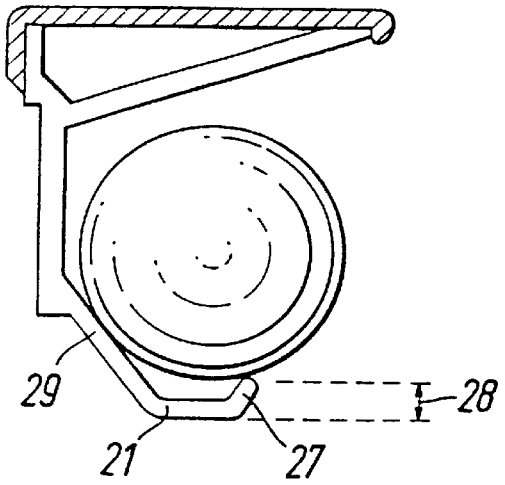
FIGS. 11A and 11B illustrate two cross sections through a moulded edge showing changes in the channel formation.
Figure 11B:
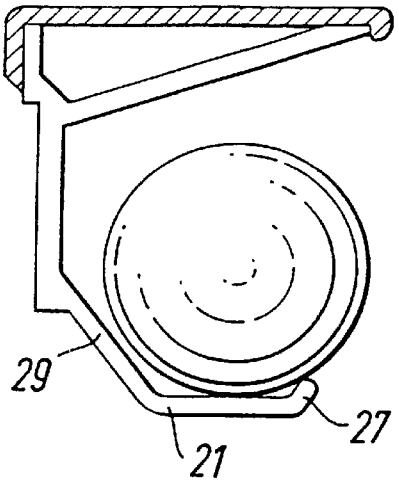

Each of the channels 21 is designed to ensure that balls passing through each pocket roll away from the pocket so as to allow them to accumulate in the channel. Since it can be inconvenient to mould sloping surfaces, particularly with open tray moulds, the channel may be formed as shown in FIGS. 11A and 11B. The channel 21 varies in width, and is wider further from the pocket (FIG. 11B). Closer to the pocket (FIG. 11A), the ball rolls on the upstanding edge 27 which diverges from the inner wall 29. Its height 28 above the bottom of the channel remains constant, but the divergence gives the ball a tendency to roll until its lower surface rests on the channel bottom (FIG. 11B). By this means the balls clear the areas of the pockets to allow other balls through later.

The structure of the plastics moulded edge member 16 is shown clearly in FIG. 4. Apart from the channel 21, the edge portion has a cushion support 23 which faces the playing surface, and a series of ribs 24 which define a flat top plane. The moulding e.g. in rigid polyurethane or fibreglass is covered by a further relatively soft single moulding 25 of rubber or plastics having areas of suitable rigidity and/or resilience. In particular, the downwardly directed portion 26 (see FIG. 6) is more resilient to ensure that balls which hit against it rebound at an appropriate speed. A soft rubber layer may be incorporated. The moulding 25, 26 may have a soft rubber interior and a harder skin or outer layer (equivalent to the playing surface construction described later). It is also important that the cushion outer-surface since it is not covered with cloth has the same frictional properties relative to a ball. Otherwise, spin on a ball will produce an exaggerated or a diminished effect. The harder skin can be chosen to provide an effect which mimics the effect of a conventional cloth-covered cushion.

Figure 6:
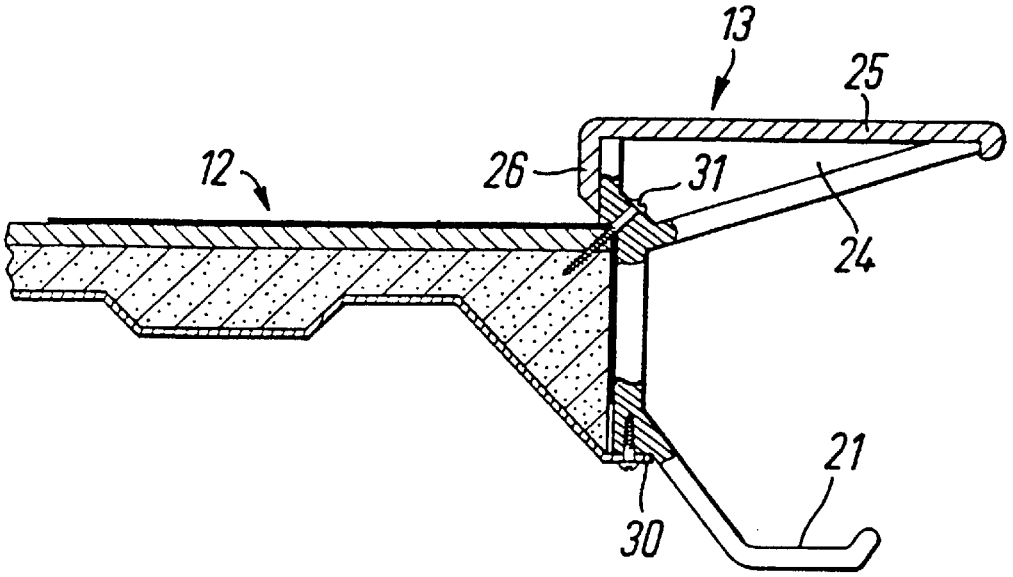

The entire edge of the playing bed can be formed in a suitable number of sections, for example two sides and two ends, or may even be formed in one single moulding. The method of attachment to the playing bed is illustrated in FIGS. 5 & 6, which show that the playing bed 12 has an external shoulder 30 to which the edge moulding is screwed. Further diagonal screws 31 secure the upper part.

Figure 12:
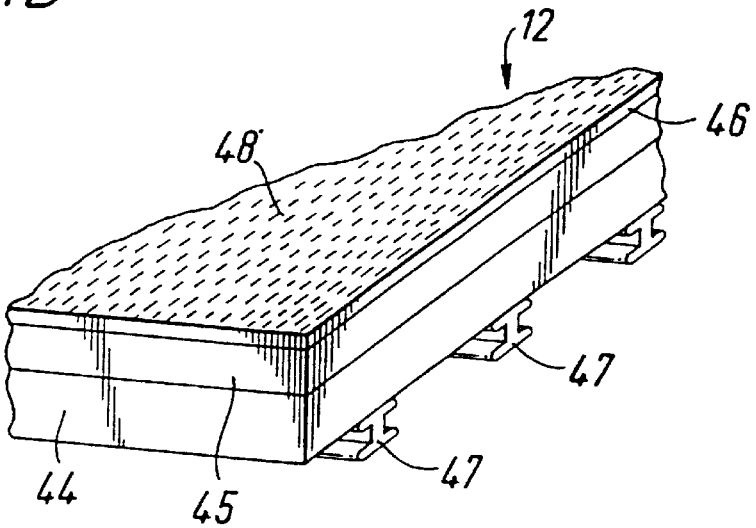
FIG. 12 illustrates a corner of a modified form of playing bed.

The playing bed 12, which in conventional good quality billiards tables is made of slate, in this instance has a sandwich construction. This consists of a lower corrugated metal plate 32, a top layer 33 of rigid and extremely hard plastics e.g. rigid polyurethane, and between the two a filling 34 10–30 mm thick of rigid foam plastics or rubber (FIG. 7), for example polyurethane of density 200 kgs/cu.m. In an alternative construction (FIG. 12) the playing bed 12 may comprise a solid inflexible, flat base of chipboard, blackboard, moulded fibre-glass or polyurethane 44, an intermediate relatively resilient layer 45 of soft rubber, neoprene or the like, and a playing surface layer 46 which is relatively hard but flexible. The intermediate layer has a thickness of 2 mm minimum with a shore hardness in the range A25 to A50. The playing surface layer has a thickness in the range 0.75 to 5 mm and a shore hardness in the range D40 to D75. It may be made of polyurethane. A metal framework 47 to which the legs are attached may support the playing bed, including cross members to ensure that the base remains exactly flat.

Figure 8:
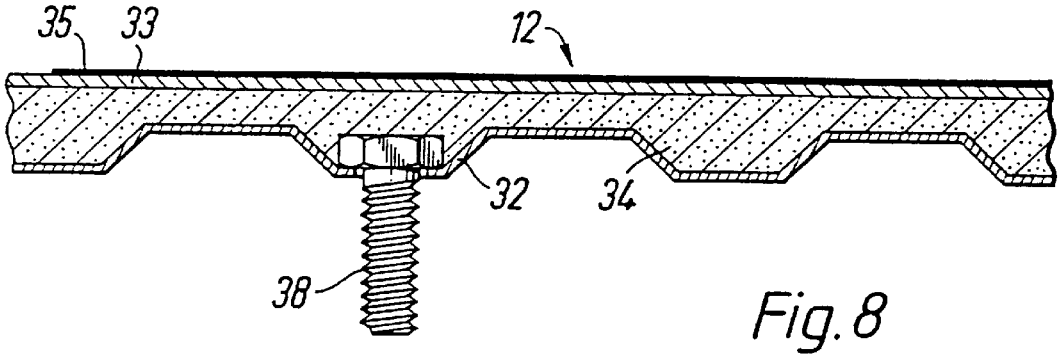
FIG. 8 shows a cross section through the playing bed at a point where a leg is to be attached.
Figure 9:
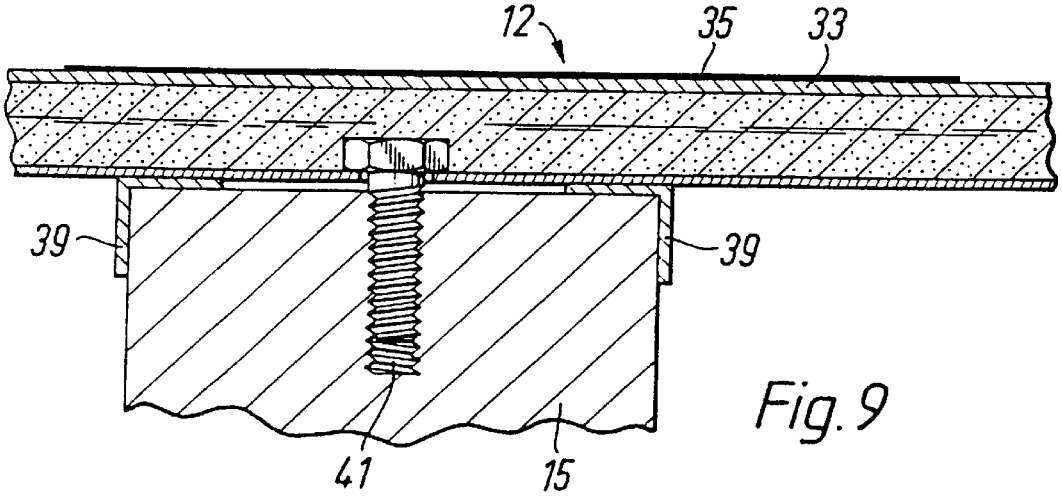
FIG. 9 shows a cross section through the playing bed at right angles to FIG. 8, with a leg attached.

The normal top playing surface is a green woven cloth which can be provided in one of two ways. A woven or other cloth material may be adhered as a surface finish 35 to the rigid layer 33. (FIGS. 8 & 9). In an alternative, the rigid layer 46 (FIG. 12) is moulded on its integral top surface with a representation 48 of accurate moulding material. In particular the latter alternative provides a playing surface which is quite unaffected by rainwater. If a surface cloth is used, it may also be of nylon or terylene which will dry satisfactorily after rain. As a result of these measures, and the fact that the whole table is formed from moulded materials, the table can be used and left outdoors.

Figure 7:
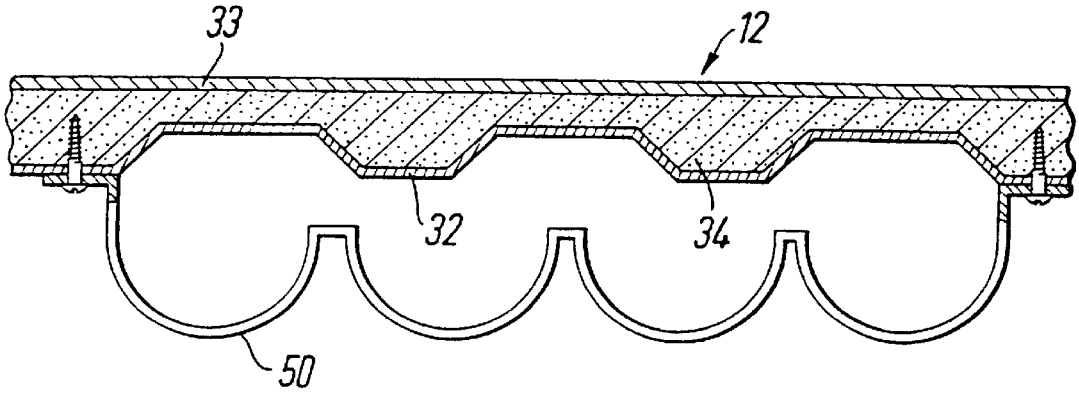
FIG. 7 shows a cross section through the playing bed.

One or more supports 50 are secured to the underside of the playing bed 12 (FIG. 7). These are aligned with the four holes through the edge member 17. The supports allow cues to be stored under the table. The supports may be metal or plastic.

A method of attaching the legs is shown in FIGS. 8 & 9. A bolt 38 is cast within layer 34 and projects through the corrugated metal sheet 32, or is otherwise attached thereto, e.g. by welding. This is positioned within one of the corrugations and lies mid-way between transverse stiffening members 39 which are welded at right angles to the corrugations. Each leg 15 has a threaded bore 41 at its upper end, which screws onto a respective bolt 38. The legs lie between the transverse members 39 which provide lateral support therefor.

Figure 10:
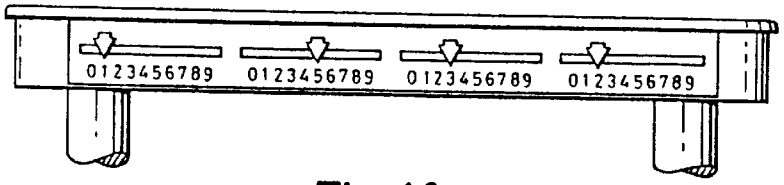
FIG. 10 shows a view of one end of the billiards table.

FIG. 10 illustrates the other end of the table in FIG. 1, which includes a scoreboard built-in.

The structure of the playing bed illustrated in FIGS. 7 to 9 or as otherwise described provides a playing surface which mimics extremely closely the characteristics of a very heavy slate bed. In particular, the surface is very hard, but the sandwich construction with a hard outer skin and a more resilient interior provides characteristics of resilience which give snooker and billiard balls both a bounce and a roll equivalent to the known beds. However, the weight is many times less. As a consequence, a billiards table of this construction can be bought and used in circumstances where a normal billiards table could not. The weight of the table (about 60 kgs) is such that specially strengthened floors are not required. Moreover, the table can be conveniently moved between outdoors and indoors and vice-versa, particularly if wheels are fitted at one end. The materials used allow the table to be left outdoors and it will not be harmed by rain or sun. Further, the overall construction of the table, large parts of which are moulded plastics, allows production at a much lower price. The fact that the legs can be unscrewed allows the table to be stored much more conveniently.

The plastics construction also allows all necessary accessories to be cheaply built in so that extra cost is avoided.

I claim:

1. A panel member suitable for use with a billiards table having a playing bed and legs and said playing bed is of sandwich construction and said panel member comprising:

a solid inflexible base layer;

an intermediate layer which is in continuous contact with the base layer and which is resilient compared to the other layers of the playing bed;

and a playing surface layer which is hard but flexible compared to the base layer, the construction of said playing surface layer being such that a billiards ball has a bounce thereon the playing bed which is substantially equivalent to the bounce on a slate bed for a billiards table.

2. A panel member as claimed in claim 1, wherein the intermediate layer has a shore hardness in the range A31 to A40 and the playing surface layer a shore hardness in the range D50 to D65.

3. A panel member as claimed in claim 1, wherein the intermediate layer is selected from the group consisting of foam rubber, and synthetic rubber with a thickness of at least 2 mm.

4. A panel member as claimed in claim 1, wherein the playing surface layer is of polyurethane with a thickness of 1 to 1.5 mm.

5. A panel member as claimed in claim 1, wherein the solid inflexible base is selected from the group consisting of sheet metal (32), or chipboard, blockboard, moulded fibre-glass or polyurethane (44) supported on metal bars.

6. A panel member as claimed in claim 1, wherein the legs are mounted on the underside of the bed and are removable for storage.

7. A panel member as claimed in claim 1, wherein the table has wheels to allow the table to roll.

8. A panel member as claimed in claim 1, wherein the playing surface layer is selected from the group consisting of a cloth sheet cover and a top surface which is moulded to simulate a cloth finish.

9. A panel member as claimed in claim 1 further including an edge member for said playing surface layer formed by moulded plastics and having a cushioned surface, and legs fixed to the underside of the billiards table.

10. A panel member as claimed in claim 9, wherein the legs are mounted on the underside of the playing bed and are removable for storage.

11. A panel member as claimed in claim 9, wherein the billiards table has wheels to allow the table to roll.

12. A panel member as claimed in claim 9 wherein said edge member is formed of moulded plastics and incorporates external channel formations to receive balls, which communicate with pockets through said edge member, each channel formation including a base and upstanding from the base a wall and an edge, the distance between the wall and the edge gradually increasing away from the pockets to cause a ball in the channel to roll away from the pockets.

13. A panel member as claimed in claim 12, which has said billiard table pockets at each corner and in the middle of the two long sides, wherein the channel formations extend along the long sides.

14. A panel member as claimed in claim 13, wherein on each side, one corner pocket shares a channel formation with the middle pocket on that side.

15. A panel member as claimed in claim 12, wherein the wall provides a second edge, both edges being of constant height above the base.

* * * * *